US008540005B2

(12) United States Patent
Baugh et al.

(10) Patent No.: US 8,540,005 B2
(45) Date of Patent: Sep. 24, 2013

(54) APPARATUS AND METHOD FOR MONITORING AND CONTROLLING A COVERING FOR AN ARCHITECTURAL OPENING

(75) Inventors: James Baugh, Denver, CO (US); Daniel Fluckey, Englewood, CO (US); Michael S. Holford, Gilbert, AZ (US)

(73) Assignee: Hunter Douglas Inc., Pearl River, NY (US)

( * ) Notice: Subject to any disclaimer, the term of this patent is extended or adjusted under 35 U.S.C. 154(b) by 88 days.

(21) Appl. No.: 13/123,555

(22) PCT Filed: Oct. 20, 2009

(86) PCT No.: PCT/US2009/061237

§ 371 (c)(1),
(2), (4) Date: Jun. 23, 2011

(87) PCT Pub. No.: WO2010/048118

PCT Pub. Date: Apr. 29, 2010

(65) Prior Publication Data

US 2011/0253320 A1 Oct. 20, 2011

Related U.S. Application Data

(60) Provisional application No. 61/106,806, filed on Oct. 20, 2008.

(51) Int. Cl.
*A47H 5/00* (2006.01)

(52) U.S. Cl.
USPC ..... 160/84.02; 160/168.1 P; 160/310

(58) Field of Classification Search
USPC ..... 160/84.02, 168.1 P, 310; 324/1, 324/174, 207.25
See application file for complete search history.

(56) References Cited

U.S. PATENT DOCUMENTS

| | | | | |
|---|---|---|---|---|
| 5,170,108 | A | 12/1992 | Peterson et al. | |
| 6,116,320 | A * | 9/2000 | Peterson | 160/84.02 |
| 6,680,594 | B2 | 1/2004 | Collett et al. | |
| 6,794,778 | B1 * | 9/2004 | Walker et al. | 310/77 |
| 7,259,485 | B2 * | 8/2007 | Cavarec et al. | 310/77 |
| 8,193,742 | B2 * | 6/2012 | Skinner et al. | 318/34 |
| 2004/0070391 | A1 * | 4/2004 | Muszynski | 324/207.22 |
| 2007/0000622 | A1 * | 1/2007 | Reed et al. | 160/188 |
| 2008/0047673 | A1 | 2/2008 | Meewis et al. | |
| 2011/0253320 | A1 * | 10/2011 | Baugh et al. | 160/127 |

* cited by examiner

*Primary Examiner* — Blair M. Johnson
(74) *Attorney, Agent, or Firm* — Dorsey & Whitney LLP

(57) ABSTRACT

An apparatus and method associated with the extension and retraction of a covering for an architectural opening. More particularly, an apparatus and method which monitors the extension of a shade to control the extension and position when the extension motion of the shade is interrupted.

20 Claims, 13 Drawing Sheets

APPARATUS AND METHOD FOR MONITORING AND CONTROLLING A COVERING FOR AN ARCHITECTURAL OPENING

CROSS REFERENCE TO RELATED APPLICATIONS

This application is the national stage application of PCT Patent Application No. PCT/US2009/061237 filed on Oct. 20, 2009 and entitled "Apparatus and Method For Monitoring and Controlling a Covering For an Architectural Opening," which claims the priority under 35 U.S.C. §119(e) to U.S. provisional patent application No. 61/106,806 entitled "Apparatus and Method For Monitoring and Controlling a Covering For an Architectural Opening" filed on Oct. 20, 2008, which is applications are hereby incorporated by reference into the present application in its their entirety.

This application is also related to U.S. application Ser. No. 29/326,484 filed on Oct. 20, 2008 and entitled "Closure Panel For a Headrail For an Architectural Opening" and is hereby incorporated by reference herein in its entirety.

FIELD OF THE INVENTION

The present invention relates generally to a method and apparatus for monitoring and controlling a covering for an architectural opening, and more particularly to detecting the position and movement status of a collapsible shade as it is being extended.

BACKGROUND OF THE INVENTION

Coverings for architectural openings such as windows, doors, archways and the like have assumed numerous forms for many years. Early forms of such coverings consisted primarily of fabric draped across the architectural opening, and in many instances the fabric was not movable between extended and retracted positions relative to the opening.

Retractable coverings for architectural openings, herein referred to as shades, have evolved into many different forms, which include roller shades in which a piece of flexible material can be extended from a wrapped condition on a roller to an extended position across the architectural opening, and vice versa. Other popular forms of retractable coverings for an architectural opening include Venetian blinds, vertical blinds, cellular shades and various variations on these basic designs. Cellular shades, as opposed to roller shades, generally collapse and stack up when retracted, and expand or extend when in the extended position.

Typically, shades of virtually any type may be manually retracted and extended by the user. More recently systems have been developed to automatically retract and extend shades. These automatic systems employ motors and various counter techniques to determine the position of the shade, and its direction of motion.

One issue with current automatic apparatus and methods for monitoring and controlling is that they may not accurately indicate the position of the window covering when being extended. Also, they also may not effectively indicate when the shade is obstructed during its downward motion.

It is to satisfy the above-recognized issues that the present invention has been developed.

BRIEF SUMMARY OF THE INVENTION

An apparatus and method associated with the extension of a covering for an architectural opening is described herein.

The invention includes a mechanism for indicating a position of a shade member moving in an extending direction and includes a shade member movable between a retracted and an extended position, a motor drive, an actuation member operably associated with the shade member and responsive to the motor drive to cause the retraction and extension of the shade member, a control system operably associated with the motor drive, the control system monitoring at least one performance characteristic of the shade member and providing at least one control signal to the motor drive, a drive mechanism operably positioned between the motor drive and the actuation member, the control system monitoring the at least one performance characteristic during extension of the shade member, the performance characteristic having a first value when the shade member is extending, and the performance characteristic having a second value when the shade member is stationary, and the control system sending the at least one control signal to the motor drive when the second value of the at least one performance characteristic is received.

The invention further may include a mechanism wherein the at least one control signal is an instruction to turn off the motor drive.

Additionally, the invention may include a mechanism wherein the second value of the performance characteristic is an absence of a value.

Further, the invention may include a mechanism wherein the drive mechanism is a split drive mechanism.

In a further arrangement, the invention may be included in a method of detecting an obstruction or terminal position to the extension of a shade member. The method includes providing a drive mechanism having a first orientation during the extension and having a second orientation upon contacting the obstruction or reaching the terminal position. The method may also include the drive mechanism including a first engagement member and a second engagement member, the first engagement member and the second engagement member in the first relative orientation during extension; and the first engagement member and the second engagement member in the second relative orientation upon contacting the obstruction or reaching the terminal position.

In another aspect of one invention described herein, a mechanism for indicating the interruption of a shade member moving in an extending direction is disclosed. This mechanism includes a shade member movable between a retracted and an extended position, a motor drive, an actuation member operably associated with the shade member and responsive to the motor drive to cause the retraction and extension of the shade member, a control system operably associated with the motor drive and including a sensor, a drive mechanism operably positioned between the motor drive and the actuation member, the drive mechanism including a first engagement member engaged with the motor drive and a second engagement member engaged with the actuation member, the first and second engagement members rotatable relative to one another between a first and a second orientations. The sensor sensing the rotation of the drive mechanism when the first and second members are in the first orientation, and not sensing the rotation of the drive mechanism when the first and second members are in the second orientation. The control system, upon the sensor not sensing the rotation, sending at least one control signal to the motor drive to interrupt the motor drive.

Further to this one invention, the first engagement member is a drive member and the second engagement member is a driven member.

A further aspect of the invention contemplates that the first engagement member includes a magnet having a north and a south pole, the second engagement member includes a magnet having a north and a south pole, wherein in the first orientation the north poles of each of the first and second engagement members are in proximity to one another and the south poles of each of the first and second engagement members are in proximity to one another; and the sensor is a magnetic sensor.

The invention also includes a method of detecting an obstruction or terminal position to the extension of a shade member comprising sensing the downward motion of the shade member, the downward motion being interrupted by the obstruction or by reaching the terminal position, no longer sensing the downward motion of the shade member, and providing a control signal to a motor to arrest any further downward motion of the shade member.

Other aspects, features and details of the present invention can be more completely understood by reference to the following detailed description of the various embodiments, taken in conjunction with the appended claims and drawings.

BRIEF DESCRIPTION OF THE DRAWINGS

The features and advantages of the present invention will be more readily apparent from the following detailed description, illustrated by way of example in the drawing figures, wherein.

DETAILED DESCRIPTION OF THE INVENTION

The invention described herein relates to the apparatus and method associated with the extension and retraction of a covering for an architectural opening. More particularly, the invention relates to the automatic retraction and extension of a collapsible shade structure positioned in a window, and may further apply to the extension of a window shade. It is contemplated that this invention may apply to other types of coverings for architectural openings.

Figure 1:
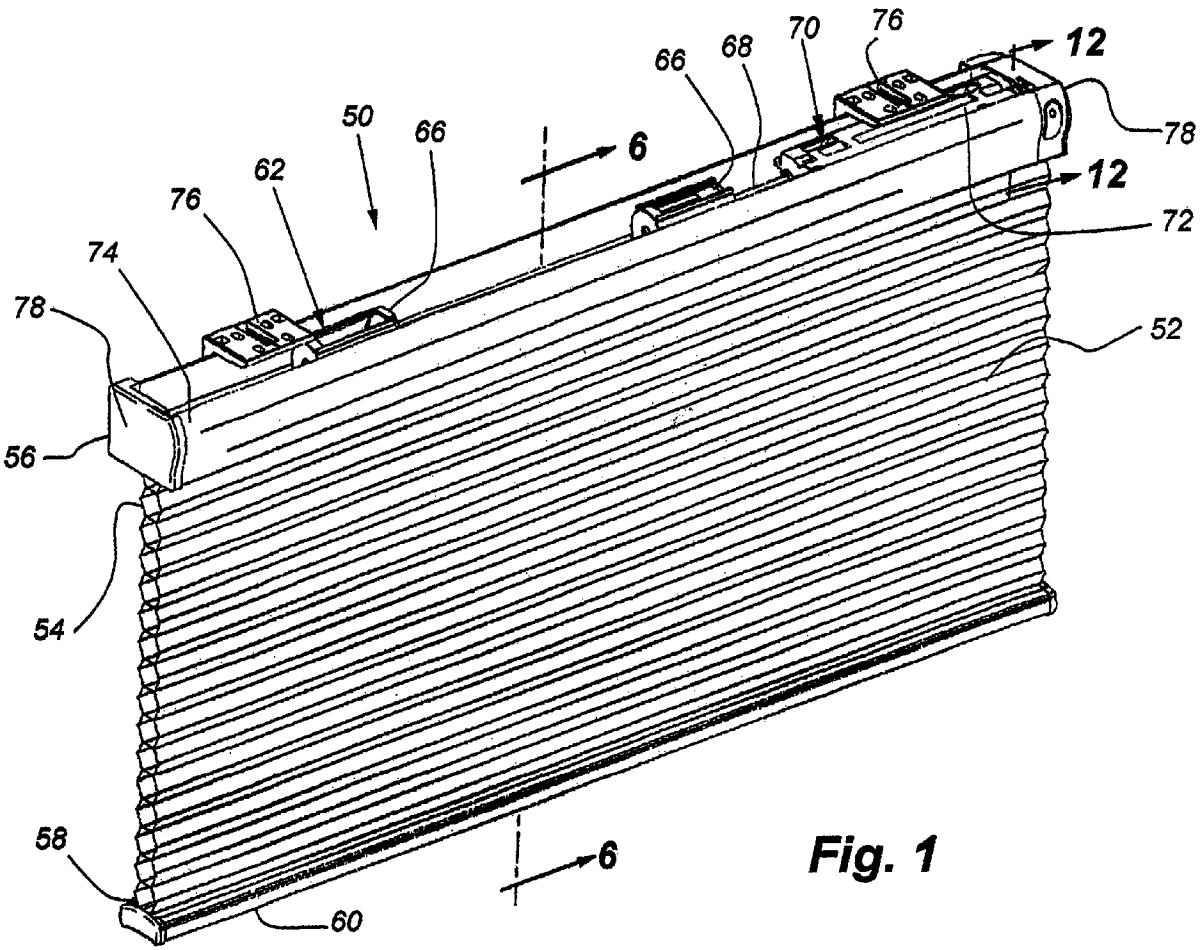
FIG. 1 shows a cellular shade system having a head rail, a collapsible shade attached to the head rail at its top portion, a bottom rail attached to the bottom portion of the shade, and a motor assembly for causing the retraction and extension of the shade.

FIG. 1 shows a shade structure 50 incorporating the present invention. The shade structure 50 includes a shade member 52 attached at or near its top edge 54 to a head rail 56, and attached at or near its bottom edge 58 to a bottom rail 60. The shade member 52 may be a collapsible cellular shade structure that effectively collapses against the bottom of the head rail 56 when retracted. When extended, the shade member 52 extends, in part, under the weight of the fabric and the bottom rail 60 as it moves downwardly away from the head rail 56.

The movement of the shade member 52 between the retracted and extended positions is controlled by a cord system 62. As is known, a cord 64 (see FIG. 4) is strung through the shade 52 and the head rail 56 to control the up and down movement of the bottom rail 60 relative to the head rail 56, which in turn causes the shade member 52 to retract or extend. The cord system 62 includes a cord 64 that attaches to the bottom rail 60 and extends through the shade member 52 up to the head rail 56. More than one cord 64 may be positioned along the width of the shade member 52 if desired. Each cord 64 may engage a spool member 66 positioned in the head rail 56, and winds onto the spool 66 when the shade 52 is retracted, and unwinds from the spool 66 when the shade 52 is extended. Each spool 66 is typically mounted on a rotating cord shaft 68 that extends along at least a portion of the head rail 56. The rotating cord shaft 68 may be driven by an actuation means, such as an automated means 70. One such automated means 70 is a motor assembly 72 operably engaging one end of the cord shaft 68. The motor assembly 72 is powered by line voltage or battery power, and is controlled by direct user inputs made by remote control or manual actuation of a control switch. It is contemplated that other means, such as mechanical means (such as a control cord manually actuated by the user), may be utilized.

Figure 2:
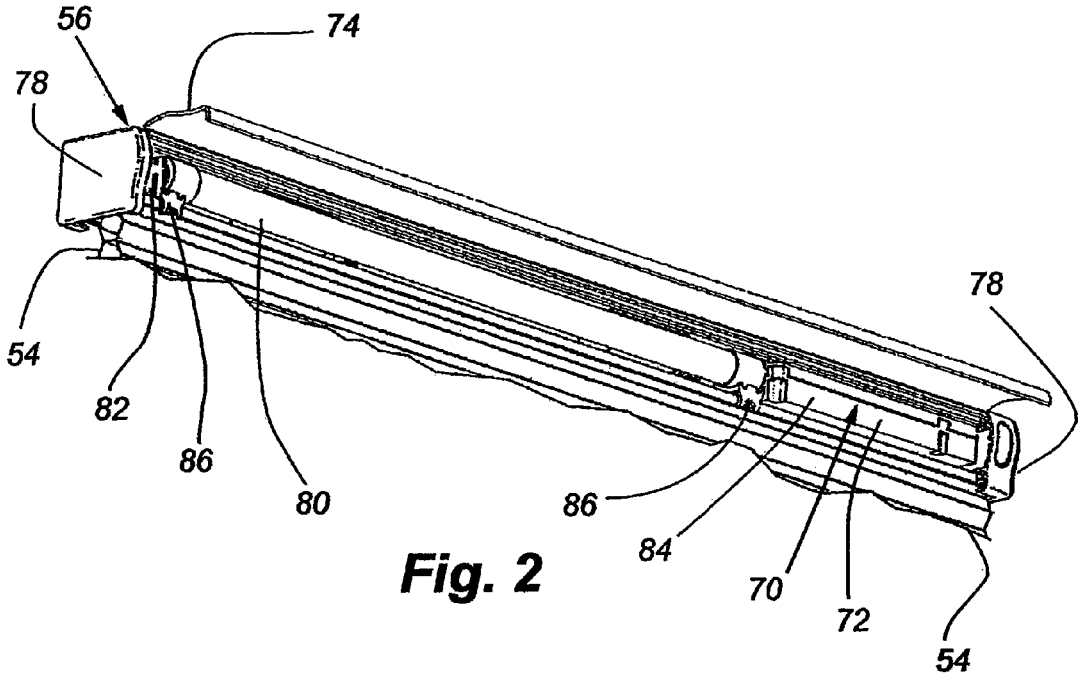
FIG. 2 shows an enlarged partial view of the shade structure of FIG. 1, with the front panel opened up to uncover the battery tube and the motor assembly.

The head rail 56 includes a front panel 74 that may be pivotable between a closed position (shown in FIG. 1) and an open position (shown in FIG. 2). Mounting brackets 76 are shown for use in mounting the head rail 56 to a structure above or adjacent the head rail. Other orientations of the brackets 76, or other brackets altogether, are contemplated to allow the head rail 56 to be attached to any suitable surface. The head rail 56 has end caps 78 to act as a cover to the internal workings of the head rail 56 and provide a finished appearance.

FIG. 2 shows the head rail 56 of FIG. 1 with the front panel 74 in the open position. In the head rail 56, behind the front panel 74, the battery tube 80 is positioned to extend along at least a part of the length of the head rail 56. The battery tube 80 is held at either end by brackets 82 that include electrical contacts for supplying power to the motor assembly 72. In this configuration, the battery tube 80 extends along the head rail largely coextensively with, and towards the front panel 74 from, the rotating cord shaft 68. The motor assembly 72 is positioned to one end of the head rail 56, and is accessible through the front panel 74. The motor assembly 72 is positioned in a housing structure 84, which may be at least partially removed to expose the motor assembly 72, explained in greater detail below. Retainer clips 86 positioned on the head rail 56 and at either end of the battery holder 80 help keep the battery holder 80 in position when the front panel 74 is opened. The battery holder 80, in this embodiment, is a cylindrical hollow tube that holds standard cell batteries 81 end to end.

Figure 3:
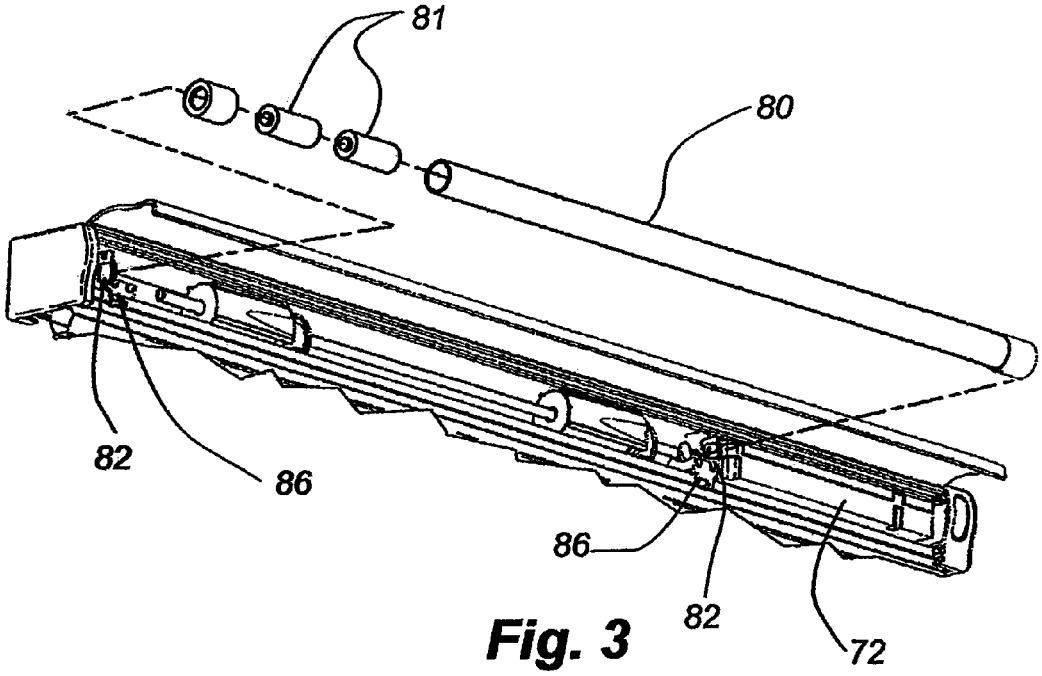
FIG. 3 is a partial view of FIG. 2, with the battery tube extracted from the head rail for clarity.

FIG. 3 is similar to FIG. 2, but shows the battery holder 80 removed from the head rail 56. The two spools 66 mounted on the rotating cord shaft 68 extend along a portion of the length of the head rail 56, and at one end engage the motor assembly 72. The motor assembly 72 drives the rotating cord shaft 68 to turn the spools 66, which in turn retract or extend the shade member 52.

Figure 4:
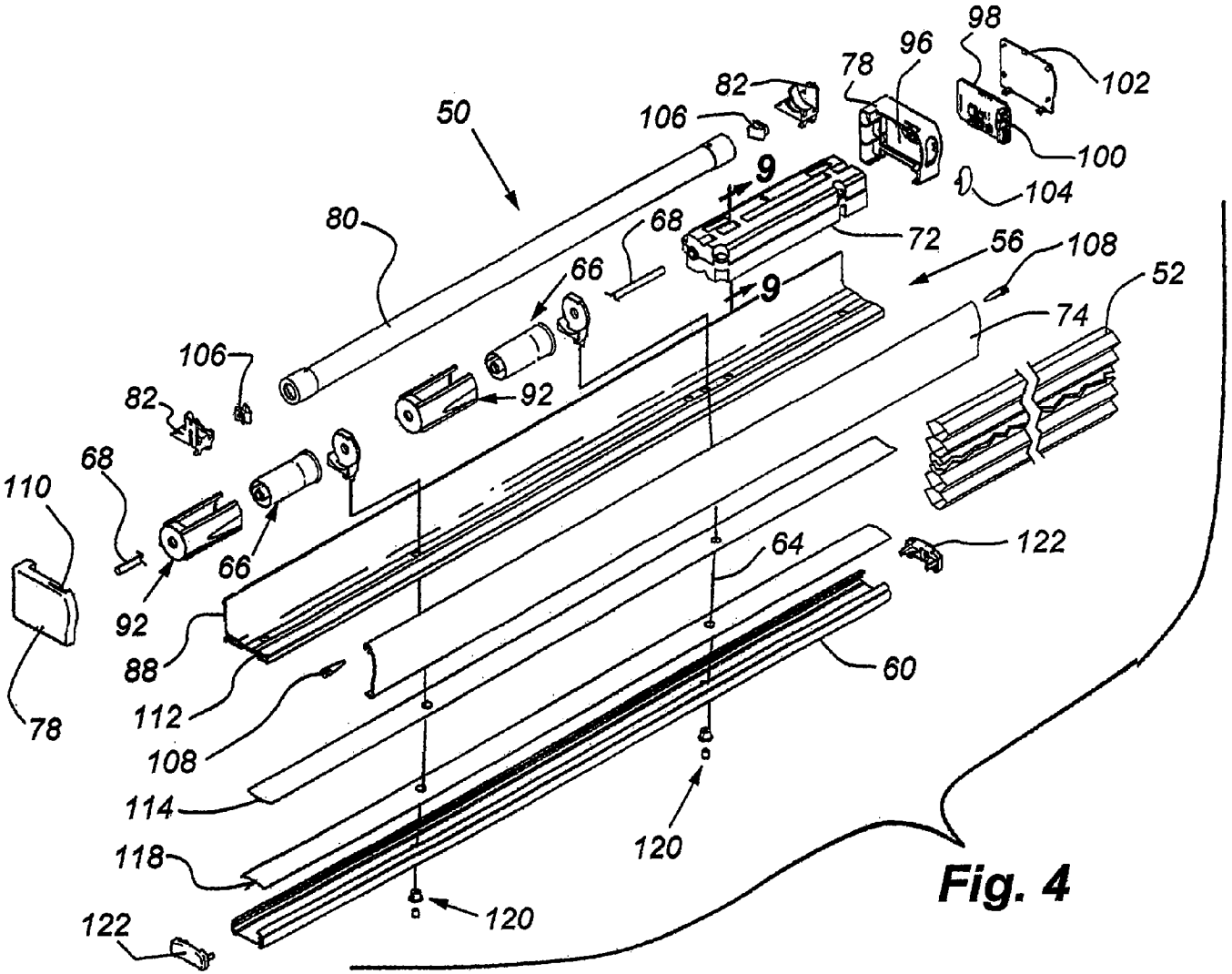
FIG. 4 is an exploded view of the head rail of the present invention.

FIG. 4 shows the components of the shade structure 50. The head rail 56 includes a head rail base 88 and two end caps 78 fastened thereto. Two spools 66 are received on the rotating cord shaft 68. The spools 66 are positioned in brackets 92 that rotatably hold the spool 66 in the head rail 56 and allow the spools 66 to rotate with the rotating cord shaft 68. One end of the rotating cord shaft 68 is supported by a spool bracket 92 near one end cap 78. The other end of the rotating cord shaft 68 is operably engaged with the motor assembly 72. The motor assembly 72 is positioned in the head rail 56, adjacent the opposite end cap 78. The opposite end cap 78 includes a recess 96 for housing a circuit board 98 that includes the manual actuation switch 100 for retracting and extending the shade member 52, among other things. An end cover 102 is used to enclose the circuit board 98 in the recess 96. A button 104 is positioned in this opposite end cap 90 to allow a user to actuate the manual actuation switches 100.

The battery holder 80 is shown, with a mounting bracket 82 positioned at either end, including contacts 106, to removably position the battery holder 80 in the head rail 56.

Figure 6:
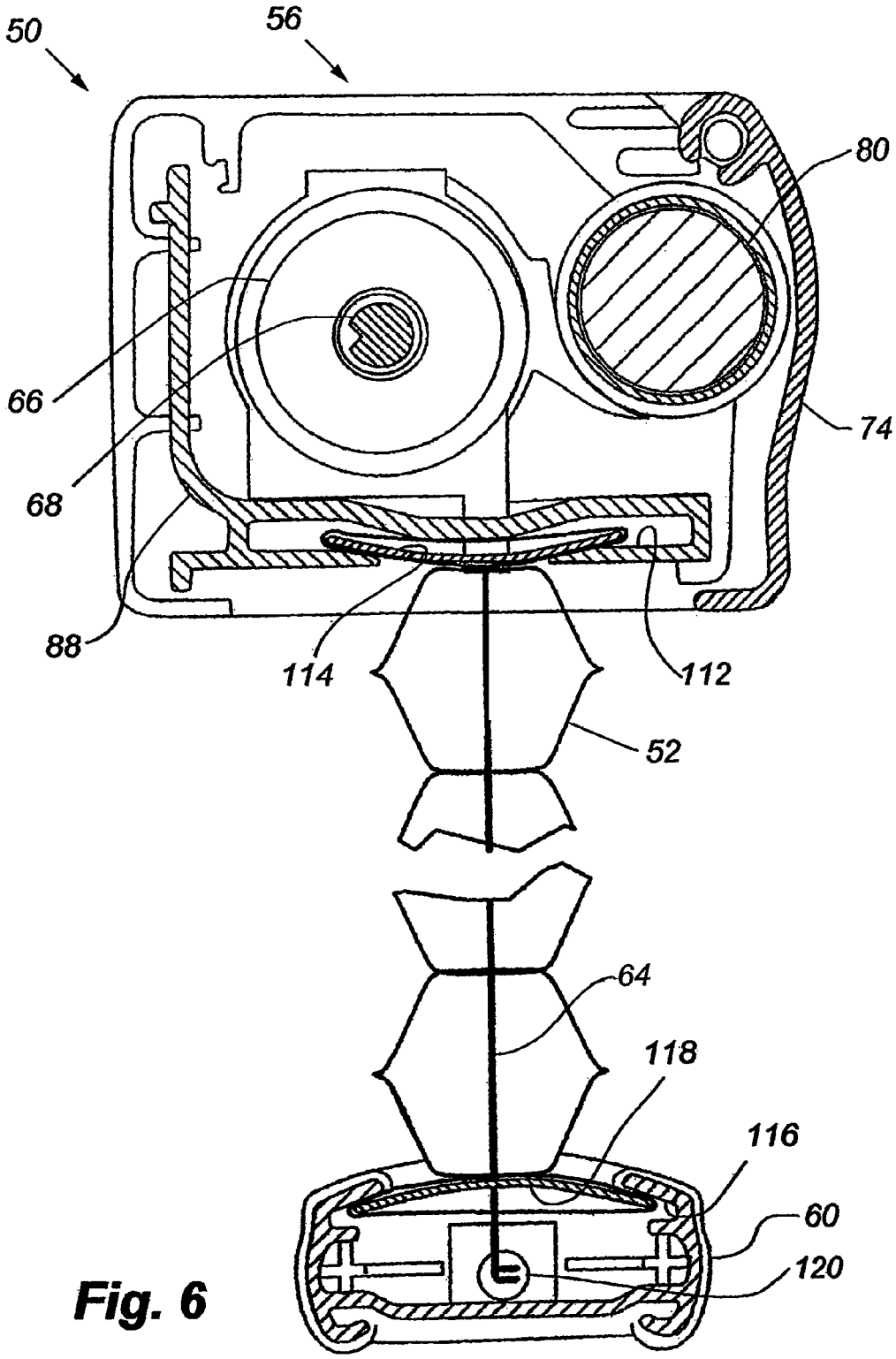
FIG. 6 is a section view taken along line 6-6 of FIG. 1.

The front panel 74 is pivotally mounted by two axle pins 108, one on either end, positioned in drop-in notches 110 formed on the top surface of both end caps 78. A slot 112, also shown in FIG. 6, is formed on the bottom of the head rail base 88 to receive a mounting slat 114 used for attaching the top of the shade member 52 to the head rail 56.

The bottom rail 60 includes a slot 116 formed on its top portion (also shown in FIG. 6) to receive a bottom mounting slat 118 used for attaching the bottom of the shade member 52 to the bottom rail 60. The cords 64 are attached to the bottom rail 60 using chord anchors 120. The cord 64 extends through the bottom slat 118, through the shade member 52, through the top mounting slat 114, into the head rail 56 and winds around a corresponding spool 66 therein. An end cap 122 may be positioned on either end of the bottom rail 60 to provide a finished appearance.

Figure 5:
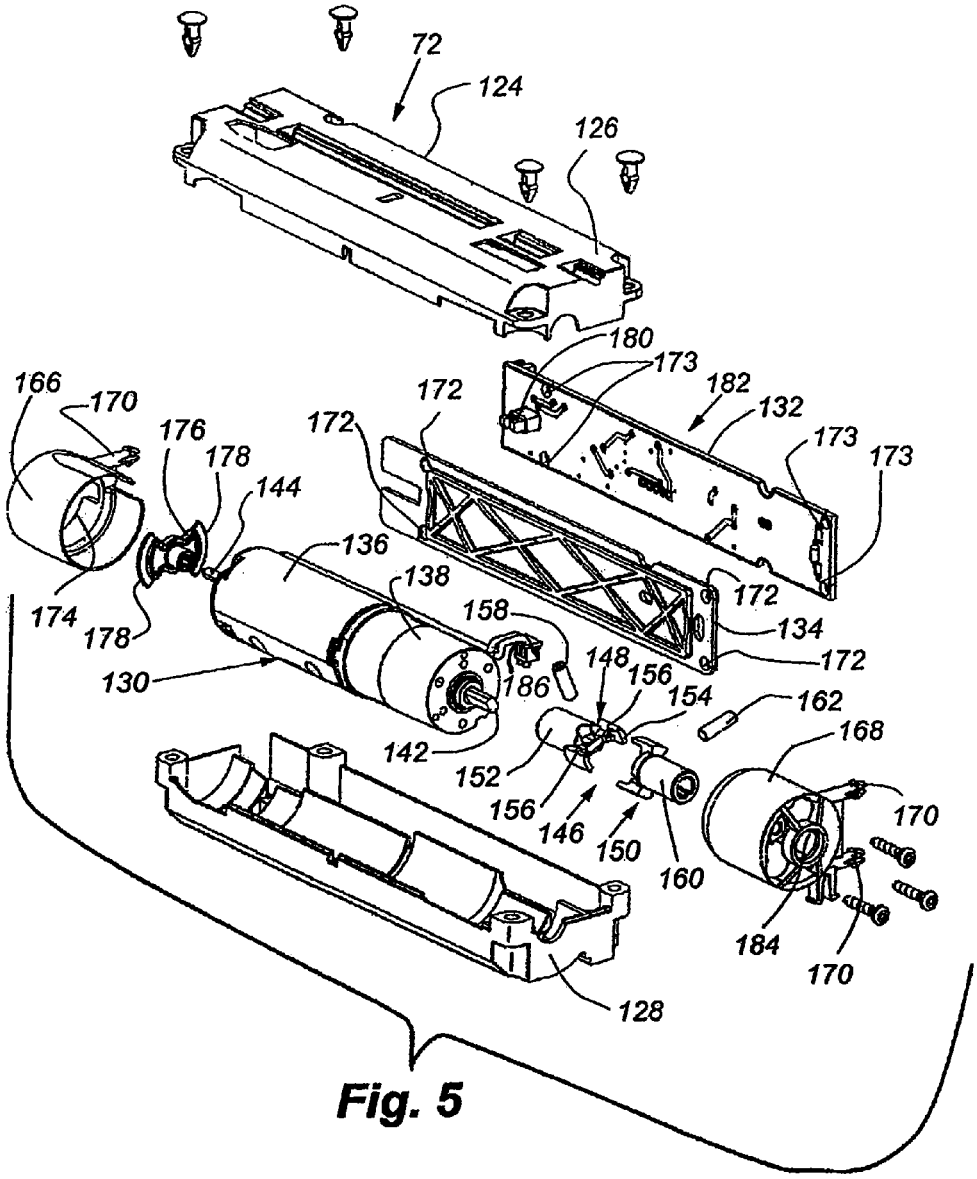
FIG. 5 is an exploded view of the motor assembly shown in FIG. 4 of the present invention.

FIG. 5 shows the motor assembly 72 in an exploded view. The motor assembly 72 includes a housing 124 formed by a top cover 126 and a bottom cover 128. The top cover 126 and bottom cover 128 at least partially enclose an electric motor drive 130 and a circuit board 132, at least partially separated by a plate 134. The electric motor drive 130 includes an electric motor 136 operably engaged with a gear reduction mechanism 138. The electric motor 136 includes a motor output drive shaft 140 (not shown) extending from one end, which engages the gear reduction mechanism 138. The gear reduction mechanism 138 includes a reduction output drive shaft 142. The electric motor 136 also includes a second shaft 144 extending from the opposite end.

A portion of a split drive mechanism 146 may be operably mounted on the reduction output drive shaft 142. The split drive mechanism 146 incorporates two similarly structured engagement members 148,150. Regarding FIGS. 7-10B, a drive engagement member 148 is mounted in rotational association with the reduction drive shaft 142. The drive engagement member 148 has a base portion 152 that mounts onto the reduction output drive shaft 142 in a manner that rotates therewith. Axially extending prongs 154 extend from the base portion 152 at radially opposing positions. Each prong 154 extends beyond the end of the base portion 152, and each has two longitudinally extending edges 156 that are angled in a radial plane. A cylindrical magnetic rod 158 may be positioned in the drive engagement member 148, and may be positioned between the prongs 154 at or near the end of the base portion 152. The cylindrical magnetic rod 158, in one example, may be oriented to longitudinally extend at right angles to the diametrically opposed prongs 154. One end of the magnetic rod has a north polarity (N), and the opposite end of the rod has a south polarity (S).

Referring still to FIGS. 5, and 7-10B, the driven, or slave, engagement member 150 has a similar structure as the drive engagement member 148. The base portion 160 of the slave engagement member 150 is rotationally associated with the cord shaft 68 (such as by a keyed engagement) that extends along at least a portion of the length of the head rail 56. A second cylindrical magnetic rod 162 is positioned in the slave engagement member 150, and extends at an angle to the diametrically opposed prongs 164 as is explained in more detail below. The split drive mechanism 146 is described in more detail below.

The electric motor drive 130 is supported in the housing 124 by a first end cap 166 positioned at the end of the electric motor 136, and an opposite second end cap 168 positioned adjacent to and surrounding the split drive mechanism 146. Each end portion 166, 168 includes latch posts 170 that pass through designated apertures 172 in the separation plate 134 and engage receptacle apertures 173 in the motor assembly circuit board 132. The first end cap 166 may include an end aperture 174. An optical sensor interrupter plate 176 is mounted on the second shaft 144. The plate 176 has two lobes 178 that pass through an optical sensor 180 on the motor assembly circuit board 132 (when the electric motor drive 130 and circuit board 132 are assembled into the motor assembly 72) to allow a control system 182 at least partially on the circuit board 132 to detect, store, assess and/or act upon the rotational speed of the second shaft 144, its revolutions per minute, and changes therein. This data may be used to control certain functions of the shade 52 retraction and extension, such as the shade position, speed of movement, location, and other information. The second shaft 144 may rotate at the same speed of the electric motor 136, or alternatively may be gear-reduced to rotate at a different speed. The rotational speed of the second shaft as related to the rotational speed of the first shaft 140 is known, and without a gear reduction on the first shaft, is typically the same.

Continuing with FIG. 5, the second end cap 168 extends from the gear reduction mechanism 138 and surrounds the split drive mechanism 146. The base portion 152 of the driven engagement member 148 is extends through and is journalled by an aperture 184 formed in the end of the second end cap 168.

The electric motor drive 130 is powered by the batteries in the battery holder 80. The battery supply is protected by an FET bridge rectifier, such as that shown in U.S. Pat. No.

4,139,880, which is incorporated herein in its entirety. This helps to lessen potential damage to the electronic components and allows the user to insert the battery tube in either direction regardless of polarity. It also avails a much lower voltage drop compared to more conventional diode protection. The battery power supply is in powered communication with the motor assembly circuit board 132, and powers at least the components there on. A power input cable 186 extends from the electric motor drive 130 to a corresponding connector on the motor assembly circuit board 132.

FIG. 6 shows a section of the head rail 56 and shade 52, with the shade 52 in an extended position. The head rail base 88 supports the cord shaft 68 and the take-up spools 66, as well as the battery holder 80. The front panel 74 is pivotally attached at its top edge to pivot upwardly to allow access to the interior of the head rail 56. The top mounting slat 114, in this configuration, may be positioned through the top cell of the shade 52 and positioned in the slot 112 in the bottom of the head rail base 88. The bottom mounting slat 118 may be positioned in the bottom cell of the shade member 52 and positioned in the slot 116 in the top of the bottom rail 60. The cords 68 extend from the take-up spool 66 in the head rail 56 to the bottom rail 60, through the shade 52. The cord 68 may be affixed to the bottom rail 60 by cord anchors 120.

Figure 7:
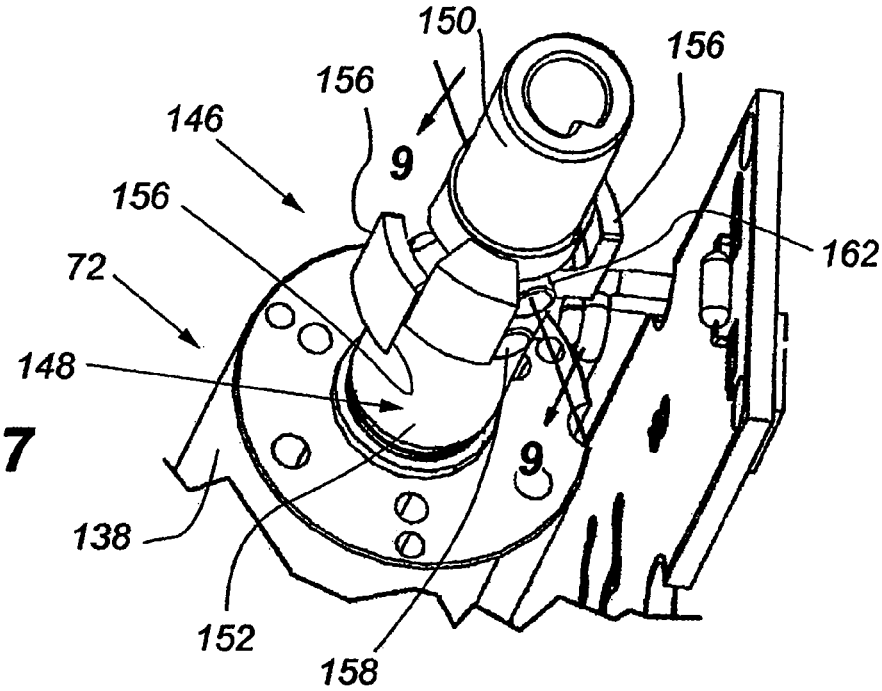
FIG. 7 is a partial view of the split drive mechanism, including the magnets shown in parallel alignment and having opposite poles adjacent one another.
Figure 8:
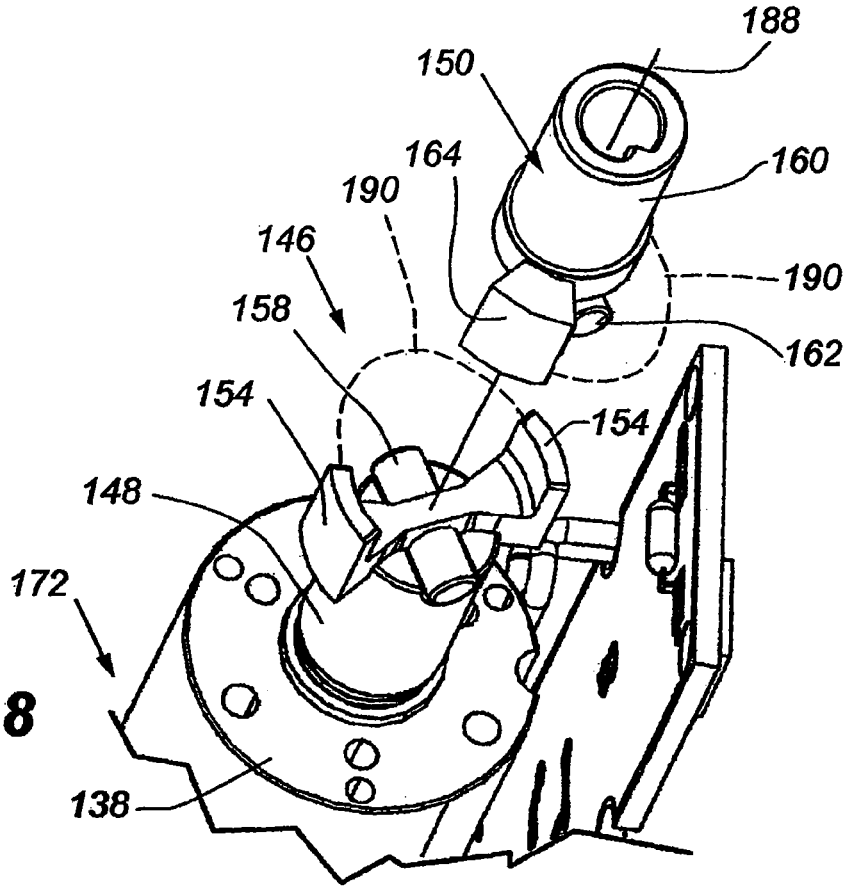
FIG. 8 is a partial view of the driving engagement element, including the base portion, prongs, and magnet, and the slave engagement element, similar to that shown in FIG. 7.

FIGS. 7 and 8 show the split drive mechanism 146 in more detail, with some portions of the motor assembly 72 removed or cut away for clarity. The drive engagement member 148 and the driven or slave engagement member 150 are positioned adjacent to each other such that their base portions 152, 160 are aligned along a common axis 188. The prongs 154, 164 of each of the drive 148 and slave 150 engagement members are spaced away from the common axis 188 by a fixed distance (radius), and in this example the same or similar fixed distance. As each of the drive 148 and slave 150 engagement members are rotated around the common axis 188, the prongs move in a circumferential path. The space between the two prongs on each engagement member 148, 150 may then be considered a circumferential gap 190. The prongs of each engagement member extend toward the other engagement member, with the prongs of one engagement member positioned in the circumferential gap 190 between the prongs of the other engagement member.

Continuing with FIGS. 7 and 8, this spatial arrangement of the prongs 154, 164 of the split drive mechanism 146 result in the engagement of the prongs of one engagement mechanism by the prongs of the other engagement mechanism when one engagement mechanism is rotated relative to the other engagement mechanism. When the prongs 154, 164 engage, such as in FIG. 7, they engage along the sides of the prongs. The side walls 156 of the prongs are radially angled so that they may engage in an abutment arrangement. Other suitable structures for adequate engagement between the prongs are contemplated. The arc length (generally, the width) of each prong 154, 164 is designed to control the amount of relative rotation between the drive 148 and slave 150 engagement members. The longer the arc length of the prong, the less relative rotation of the engagement members. The shorter the arc length, the more relative rotation of the engagement members 148, 150. In one example of the structure disclosed herein, the prongs are designed with an arc length to allow the drive member prongs 154 and the slave member prongs 164 to rotate approximately 90 degrees relative to one another prior to engagement of the prongs 154, 164. Other structures for engagement besides prongs are contemplated, such as tabs, collars, protrusion, gears, or other such structures. Other amounts of rotation prior to engagement between driven 148 and slave 150 engagement members is contemplated.

The rotation of the drive engagement member 148 is controlled by the rotation of the motor 136, through the gear reduction mechanism 138. The driven engagement member 148 and the slave engagement member 150 are operably associated with one another, in this arrangement, by contact between the prongs 154, 164. The slave engagement member is rotatably associated with the shade member 52 through the cord shaft 68, such that as the slave engagement member 150 rotates, the cord shaft 68 rotates, which causes the spool 66 to rotate and unwind the cord 64 or retract the cord 64 (depending on the direction of rotation of cord shaft 68).

In one instance, when the electric motor 136 is actuated, the output drive shaft 140 (not shown) is actuated, which in turn engages the reduction mechanism 138, which in turn engages and rotates, through shaft 142, the drive engagement mechanism 148 of the split drive mechanism 146. The drive engagement mechanism 148 then rotates relative to the slave engagement mechanism 150 until the respective prongs 154, 164 engage (there may be only one prong on each engagement mechanism, or some other rotational engagement structure suitable for this purpose). When the prongs 154 of the drive engagement member 148 engage the prongs 164 of the slave engagement member 150, the drive engagement member 148 may cause the slave engagement member 150 to rotate. This is the loaded position. As the slave engagement member 150 rotates, it causes the cord shaft 68 to rotate. This causes the cord spool 66 to let out or take in cord 64, thus allowing the shade member 52 to extend or retract, as described in more detail below.

So, when the shade member is being extended, the drive engagement member 148 rotates one direction (i.e. for example clockwise in FIGS. 10*a* and *b*) and engages the driven member 164 to cause it to rotate the cord shaft, which rotates the cord spool to unreel cord and allow the shade member to lower. When the shade member is being retracted, the drive engagement member 148 rotates the opposite direction and engages the driven member 164 to cause it to rotate the cord shaft, which rotates the cord spool to take-up cord on the spool, and thus pulls up the bottom rail of the shade member to retract the shade. Typically, the cord 64 on the spool 66 holds the bottom rail from extending the shade member until the cord shaft 68 rotates and cord 64 is rotated off the cord spool 66, which allows the bottom rail to move downwardly.

In other instances, during extension of the shade member the shade member 52 may lower under its own weight, and the motor 136 may cause the drive member 148 to follow the rotation of the driven member 150 as the shade extends.

Still referring to FIGS. 7 and 8, the magnets 158, 162 are positioned in the driven 148 and slave 150 engagement members, respectively, such that they may move from being in parallel alignment with one another (when unloaded) to being in an orthogonal alignment (when loaded). The magnets 158, 162 are placed in the driven 148 and slave 150 engagement members such that when aligned in parallel (FIG. 7), the opposite poles are adjacent each other. For instance, the north pole of the magnet 158 in the drive engagement member 148 is adjacent the south pole of the magnet 162 in the slave engagement member 150, and the south pole of the magnet 158 in the drive engagement member 148 is adjacent the north pole of the magnet 162 in the slave engagement member 150. With this magnet orientation placement, when the drive engagement member 148 and the slave engagement member 150 are able to rotate relatively freely (are "unloaded"), even from an orthogonal relative orientation, the magnetic attraction between the poles causes the magnets 158, 162 to attempt to align parallel to one another as shown in FIGS. 7, 8, and 9, and cause the drive 148 and slave 150 engagement members to adapt the corresponding orientation also.

The magnetic fields around the magnets are affected by the relative orientation of the magnets. Referring to FIG. 9, when the magnets 158 (behind 162), 162 are aligned parallel to each other in the unloaded position, with adjacent north and south poles as described above, the magnetic fields 192 around each end of the magnets 158, 162 are somewhat cancelled out and have limited extension. Referring to FIG. 10A, when the magnets 158, 162 are oriented orthogonally (in the loaded position), the magnetic field 194 around the now more adjacent South-South poles and magnetic field 196 around the North-North poles (each offset by 90 degrees in this arrangement) expands.

Figure 10A:
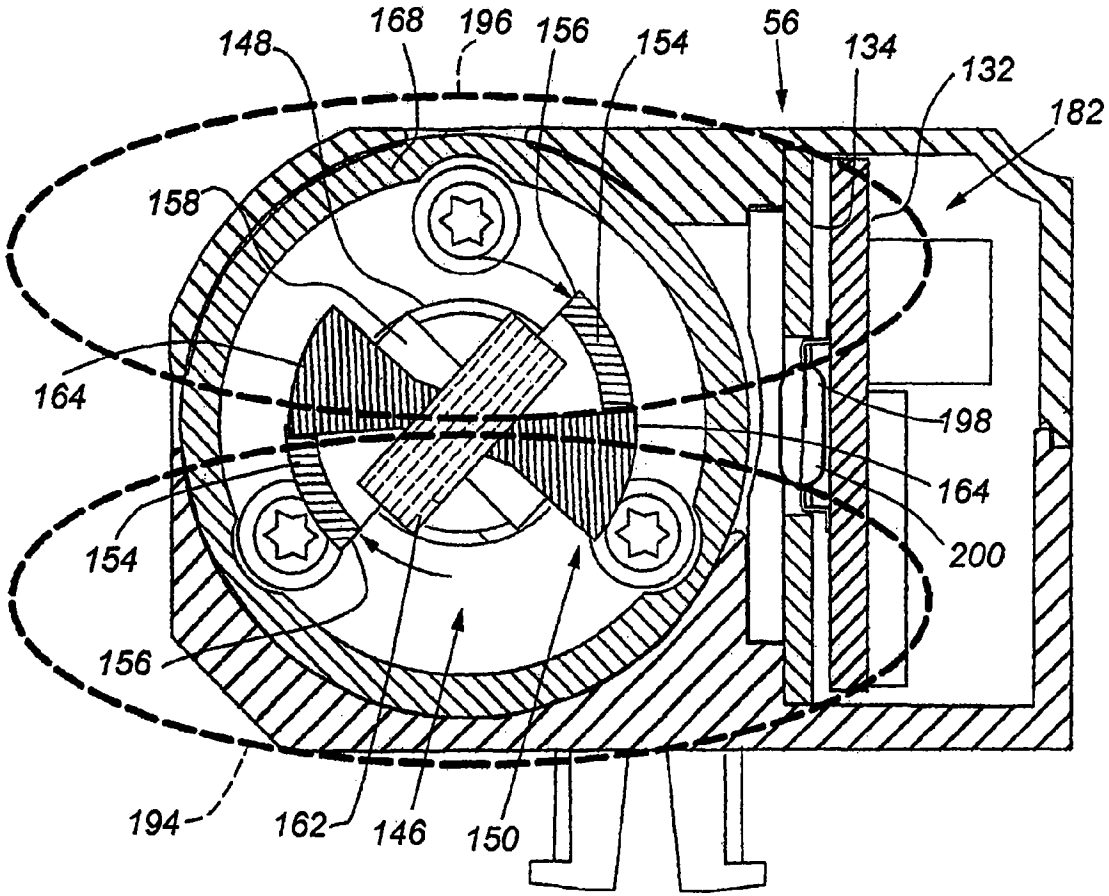
FIGS. 10A and B are representative sections similar to FIG. 9, with different amounts of rotation shown, wherein the magnets are oriented orthogonal to one another.
Figure 10B:
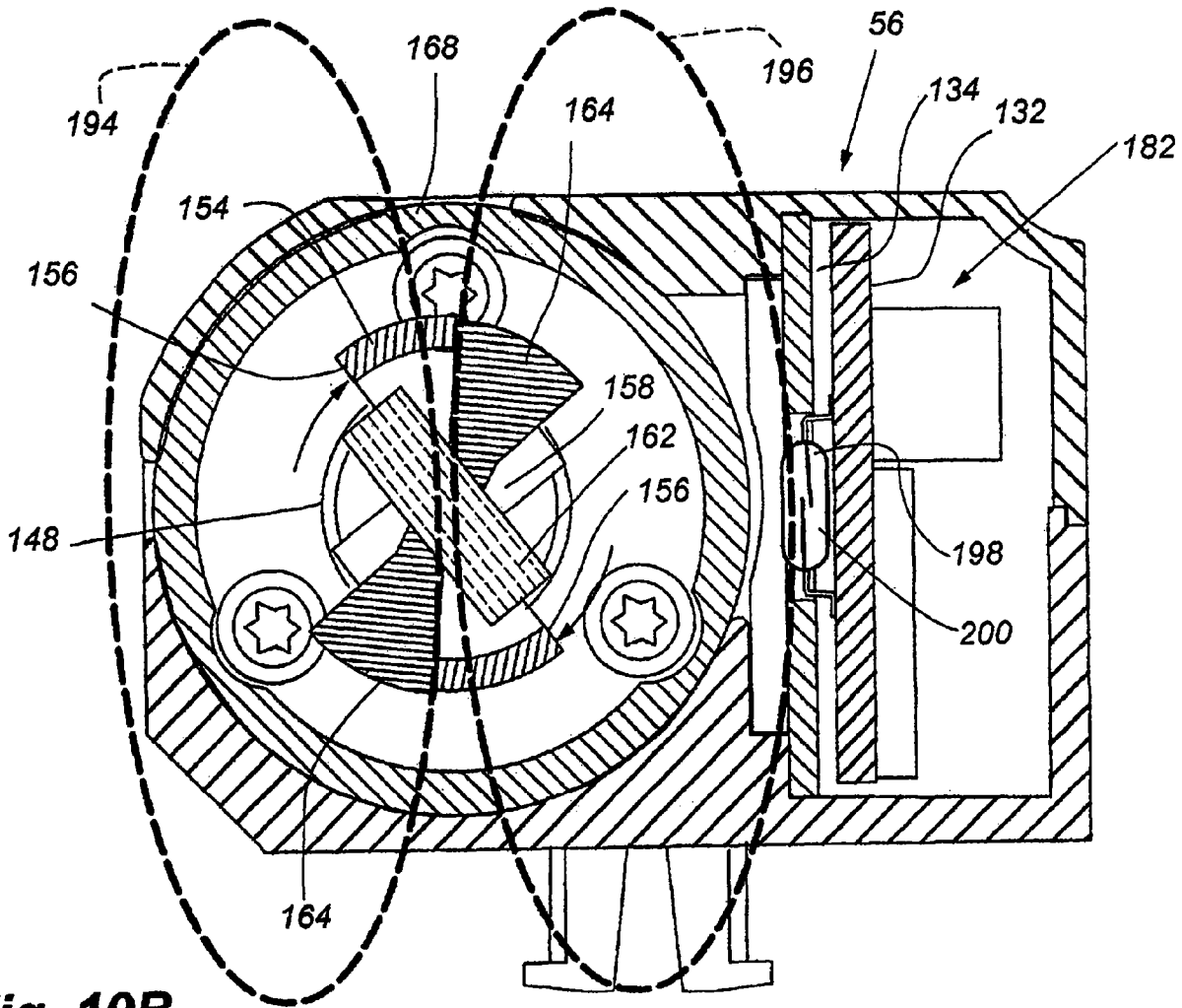
Figure 11:
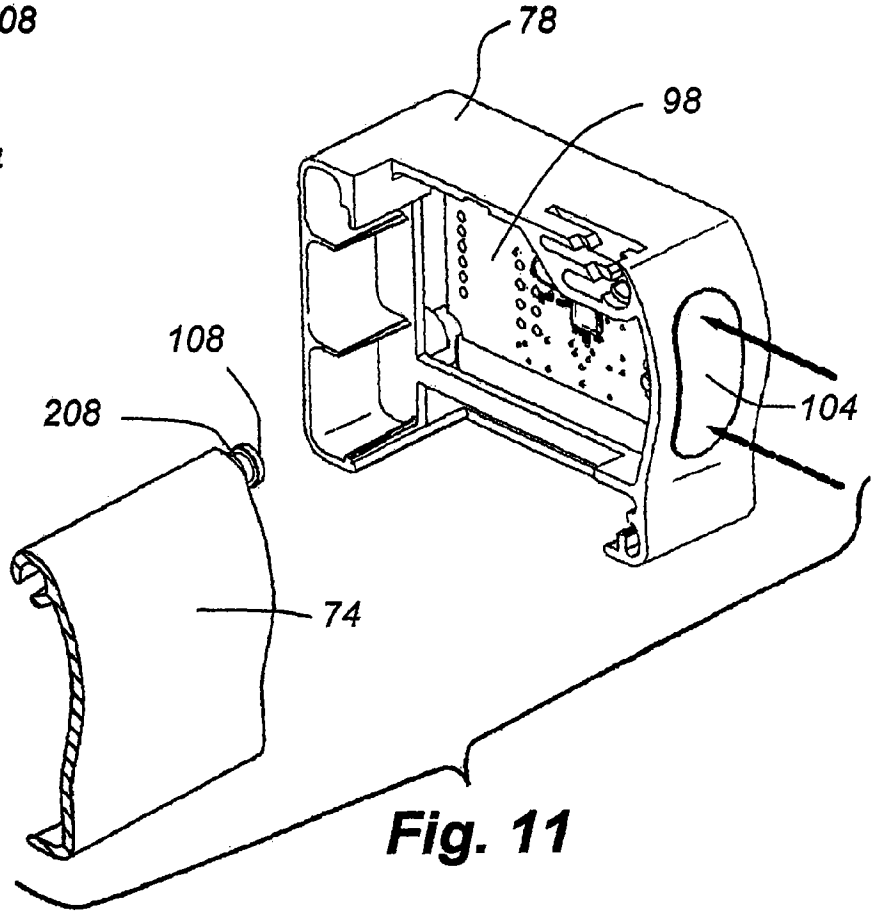
FIG. 11 is an exploded view of the end cap portion of the head rail for housing the motor drive circuit board and manual retraction and extension function.
Figure 12:
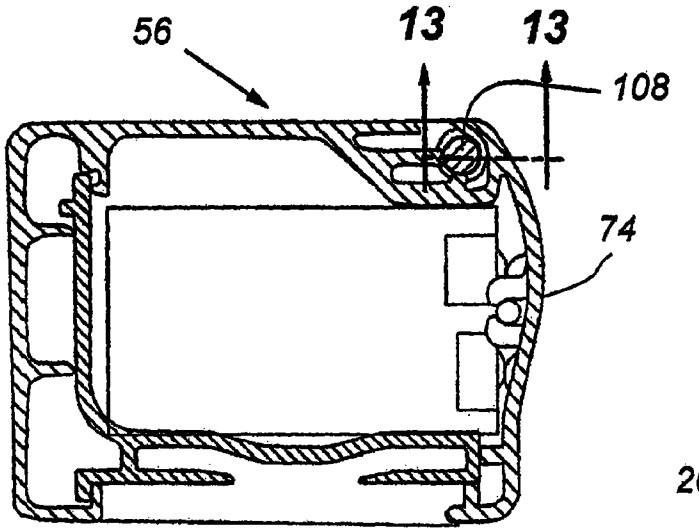
FIG. 12 is a section taken along line 12-12 of FIG. 1, and shows the pin structure for the pivotal attachment of the panel on the head rail.
Figure 13:
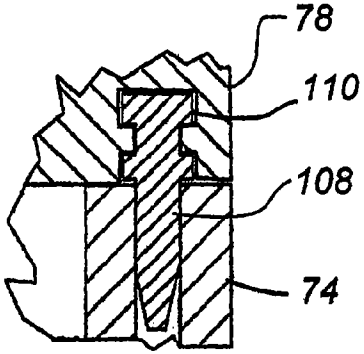
FIG. 13 is a section taken along line 13-13 of FIG. 12 and shows the pivot pin for pivotally holding the panel on the head rail base.

FIGS. 10*a*, 10*b*, and 11 show a magnetically actuated switch 198, such as a reed switch 200, positioned near the split drive mechanism 146. The reed switch 200 is in sufficiently close proximity to be actuated when the magnets 158, 162 are in the orthogonal position, and to not be actuated when the magnets 158, 162 are in the parallel position. The reed switch is operably associated with the control system 182. This is illustrated in more detail below.

Figure 9:
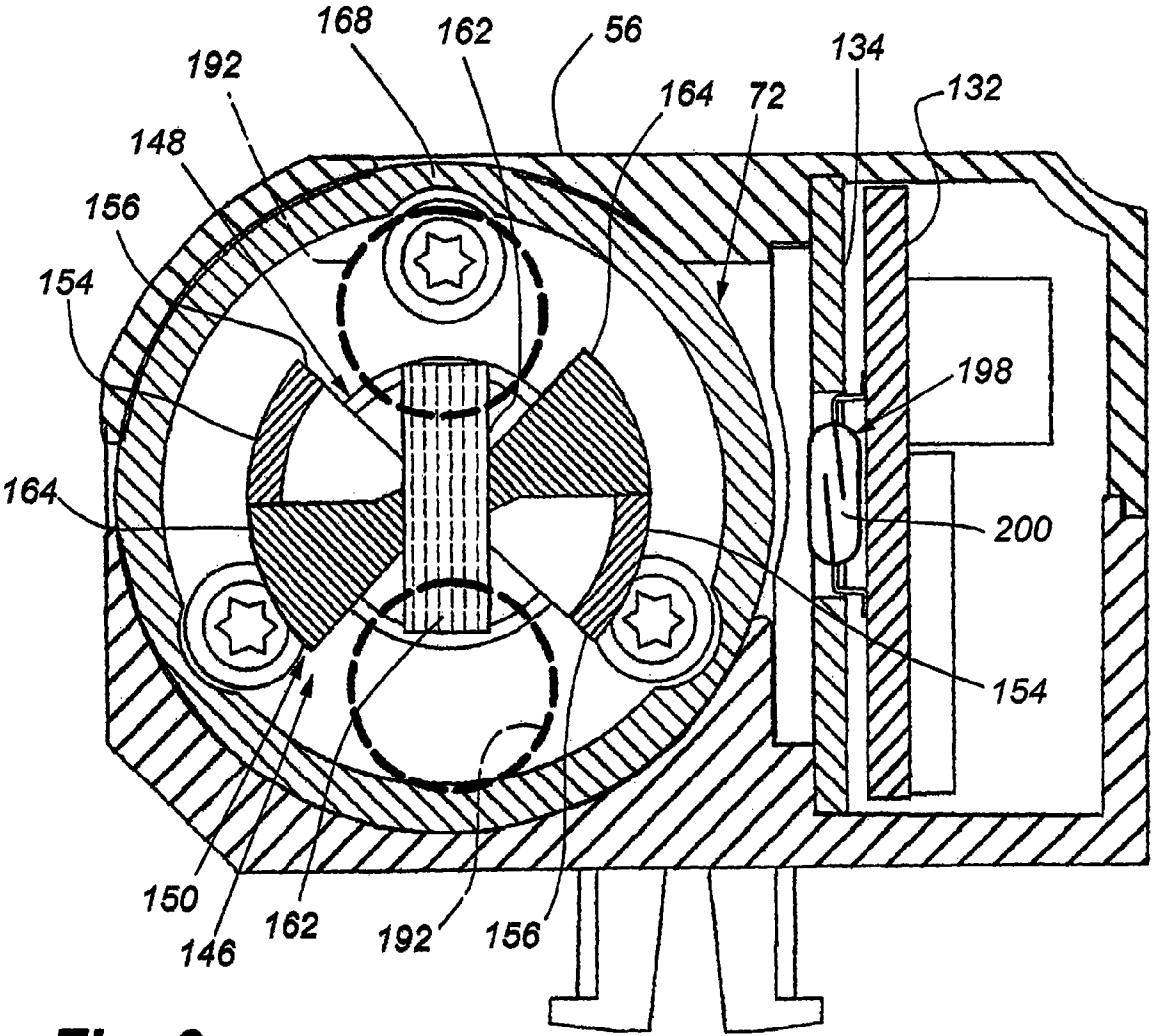
FIG. 9 is a representative section taken along line 9-9 of FIG. 4, showing the driving and slave engagement members during an unloaded arrangement, with the magnets in axial side-by-side alignment.

FIG. 9 shows a representational cross section of the head rail 56 through the motor assembly 72, taken along line 9-9 of FIG. 4, with the shade member in its fully-extended position at the end of its cord length. In this arrangement, the split drive mechanism 146 is shown with the drive engagement member 148 and the slave engagement member 150 in an unloaded state, so the drive magnet 158 and the slave magnet 162 align parallel to one another. The reed switch 200 is shown mounted on the motor assembly circuit board 132 adjacent to the split drive mechanism 146. In this orientation, the resulting magnetic fields 192 are relatively small, and the magnetic fields 192 of the parallel aligned magnets do not actuate the reed switch 200. When the control system 182 no longer receives an activation signal from the reed switch, it shuts off power to the motor. Since the split drive mechanism 146 is in the unloaded state when the shade member is at its lowest, fully extended position (i.e. where the end of the cord length is reached), or when the shade member 52 is obstructed when being extended and moving downwardly, as is described elsewhere herein, the lack of actuation signal from the reed switch triggers a power shut off to the motor to stop further downward motion of the shade.

Still referring to FIG. 9, the split drive mechanism 146 is shown in the unloaded position with the magnets 158, 162 in parallel alignment with each other, given the position of the engagement member 148, 150 with each other. The optical sensor 180 associated with the second shaft 144 at the other end of the electric motor 136, however, may continue to sense the speed and possibly direction of rotation, among other data, to provide information to the control system 182 about the shade member 52, such as the position of the shade 52 when moving upwardly, and the direction of movement. This data from the optical sensor may help the control system determine whether, and at what position, the shade motion was stopped due to full extension or due to interrupted motion.

FIGS. 10A and 10B are sections views similar to FIG. 9, except the split drive mechanism 146 is shown in the loaded state (with magnets 158 and 162 being orthogonal), such as where the shade member 52 is being extended (or lowered) from the head rail 56. With reference to FIG. 10A and B, the shade member 52 is lowered when the split drive mechanism 146 is rotated in the clock-wise direction (in other configurations it may be rotated counter clock-wise). Compared to FIG. 9, the drive 148 and slave 150 engagement mechanisms are re-oriented so the drive 158 and slave magnets 162 are orthogonal to one another, which in turn enlarges the magnetic field 194 surrounding the S-S poles and the magnetic field 196 surrounding the N-N poles of the magnets 158 and 162. The enlarged magnetic fields 194, 196 are sized sufficiently to actuate the reed switch 200 as the split drive mechanism 146 rotates. The magnetic fields 194, 196 are characterized by the dashed lines in FIG. 10A, and are meant only as representations of the relative magnetic fields. In the orientation of FIG. 10A, the reed switch 200 is actuated due to the relative locations of the magnetic fields 194 and 196. In this configuration, the reed switch 200 may be actuated 2 times for every revolution of the split drive mechanism 146. Other sensor types that are capable of sensing rotation may be implemented.

FIG. 10B shows the split drive mechanism rotated 90 degrees clockwise, where the magnetic fields 194 and 196 do not appropriately engage the reed switch to cause actuation, and thus the reed switch 200 opens. As the magnetic fields 194, 196 pass by the reed switch 200, the reed switch changes state, which data is monitored by the control system 182 for possible use thereby.

The loaded position or state of the split drive mechanism 146, which creates the orthogonal position of the magnets 158, 162, is experienced most times other than when the shade is positioned at its lowest, or most extended, position (at the end of the cord length when extended from the spool) and when obstructed in its downward extension to that lowest, or most extended, position. When the shade member 52 as described herein extends, it extends under the weight of the bottom rail 60 and the fabric of the shade member 52, which unwinds the cord 64 from the spools 66 as the electric motor 136 turns the cord shaft 68 the appropriate direction (clockwise in FIGS. 10A, 10B).

In short, the split drive mechanism 146 orients the magnets 158, 162 in a manner (loaded state) to actuate the reed switch 200, in the present arrangement, at least when the shade member 52 is being extended downwardly. This is intended to facilitate the monitoring and control of the shade structure 50, and specifically the electric motor 136, to react when the downward motion is stalled, such as when the bottom rail 60 reaches its lowermost position (i.e., the shade member is fully extended to the end of its cord length) or where the downward motion is obstructed for some reason, such as by an unexpected object. In one basic implementation, when the shade member 52 is moving downwardly, the reed switch 200 is periodically actuated by the movement of the magnetic fields 194, 196 as the split drive mechanism 146 rotates.

The actuations of the reed switch 200 is monitored by the control system 182, which includes sufficient capability (such as by a microprocessor with various inputs and outputs, associated software and the like) to collect, analyze, and/or provide feedback and control signals based on the various inputs from the shade structure 50, the motor assembly 72, and/or the user via wired, wireless (RF or IR or the like) or other types of communication of instructions. Other aspects of the performance of the shade structure 50 may be monitored and used to control or provide feedback to the control system 182 or shade structure 50. For instance, the optical sensor 180 on the second shaft 144 of the electric motor 136 senses the rpm, and other features of the rotation of the electric motor 136. The rotational rate or speed of the second shaft 144 may be indicative of the rotational rate or speed of the motor 136, while the rotational rate of the split drive mechanism 146 (and thus the cord shaft 68) may be different due to the gear reduction mechanism 138. The translation between the two is defined (such as the motor 136 running at a 4000 rpm, and the gear reduction mechanism 138 having a 69:1 reduction ratio) so the resulting data may be correlated by the control system 182 for use. The control system 182, with these varied inputs, may then be able to detect the fully retracted and fully extended position of the shade member 52, and use the rotation of the loaded split drive mechanism 146 as a means to determine where in the downward, extending, path the bottom rail 60 is positioned with some accuracy.

In operation, in one arrangement, when the shade member 52 is extended downwardly, the reed switch 200 is actuated by the rotating loaded split drive mechanism 146. When the shade 52 becomes fully extended, the cord 64 is substantially all removed from the cord spool 66 on the cord shaft 68, and the cord 64 transfers the load from the front of the spool 66 to the rear of the spool 66 as the spool rotates and the attachment points between the cord 64 and the spool 66 rotates from the front (right side) of FIG. 6 to the rear (left side) of FIG. 6 before the motor is shut off. This unloads the split drive mechanism 146, and may rotate the engagement mechanisms of the split drive mechanism to allow parallel alignment of the magnets. In the unloaded condition, the magnets 158, 162 move to a parallel alignment (under the inherent magnetic attraction between the north and south poles of each magnet 158, 162) and the magnetic fields 192 are reduced in size. The reed switch 200 is then no longer actuated. The control system 182 may interpret the absence of signal from the reed switch 200 as meaning the bottom rail 60 is at its lowest-most position and may instruct the electric motor 136 to shut off.

Figure 15:
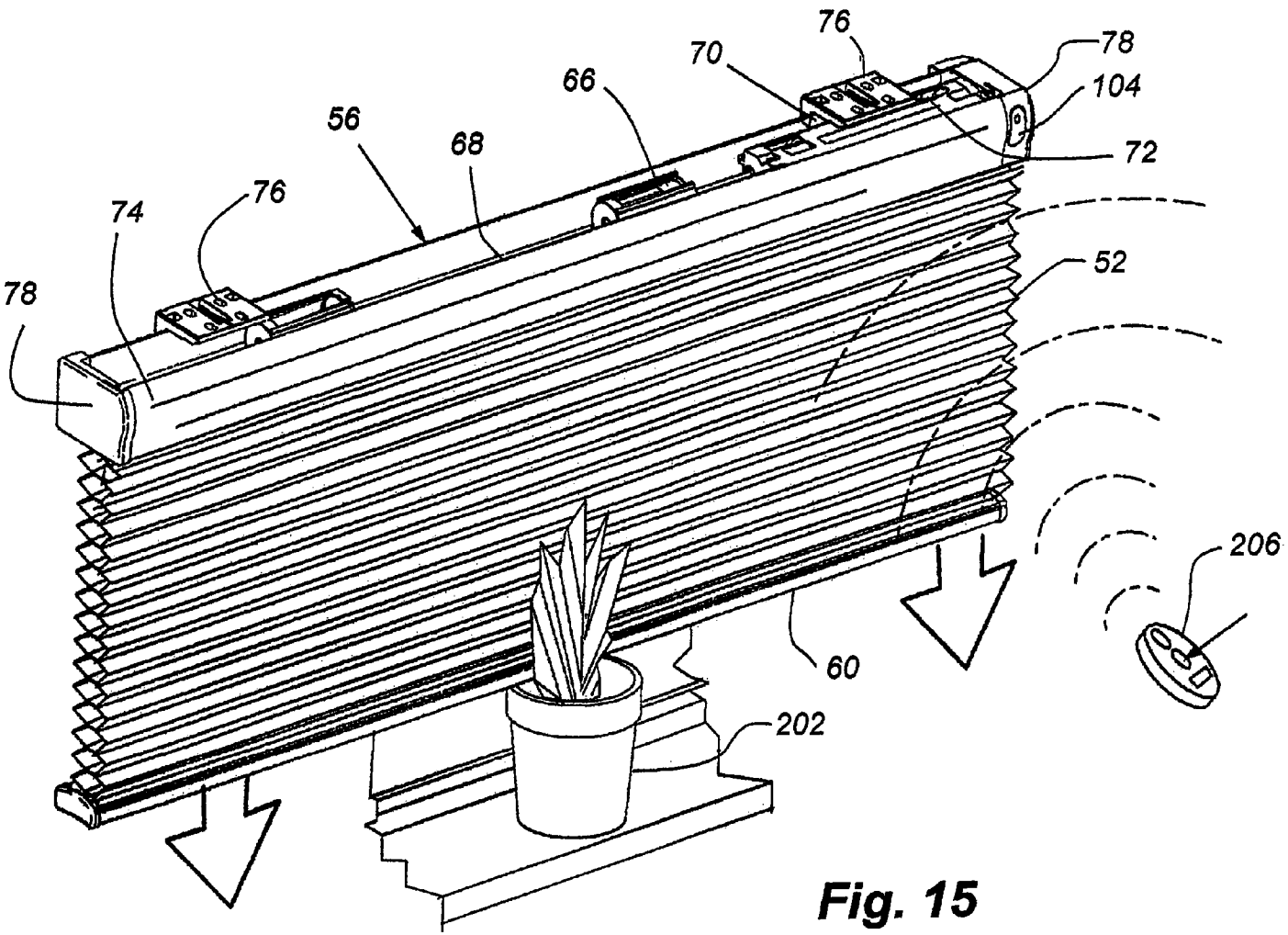
FIG. 15 is a partial perspective view of the shade member moving downwardly and being obstructed by an object, causing the control system to turn off the electric motor and stop the downward motion.

Alternatively, with reference to FIG. 15, as the shade member 52 is being extended with the split drive mechanism 146 in a loaded status (thus actuating the reed switch 200), the motion of the bottom rail 60 may be obstructed by an object 202 in or near the architectural opening 204. This obstruction may cause the transition of the split drive mechanism 146 from a loaded to an unloaded status, thus allowing the magnets 158 to align and reduce the size of the magnetic field 192. The reed switch 200 would thus no longer be actuated. The lack of signal from the reed switch may be interpreted by the control system 182 as an obstruction, and thus instruct the electric motor 130 to shut down to mitigate any damage to the shade structure 50 until the obstructing object 202 may be removed. Upon removal of the obstruction 202, the user may instruct the control system 182 to direct the shade member to continue moving downwardly (or upwardly). As noted above, it is contemplated that the control system 182 may allow either manual control by a user, or remote control 206 via RF, IR or other such wireless technology.

In the current configuration, the split drive mechanism 146 actuates the reed switch while extending and retracting since it may be in the loaded configuration during both motions. The control system 182, in one configuration, ignores the signal from the reed switch 200 during retraction since as described regarding FIG. 15, the control system is monitoring primarily for the obstruction of the extending shade member 52, and the occurrence of the fully extended position. However, the control system 182 may be programmed to monitor the actuation of the reed switch 200 during both extension and retraction to provide various data related thereto. The split drive mechanism may also be designed such that when retracting the magnets may be aligned and thus not cause the reed switch to activate. The motor 130, in one embodiment, is a two-way motor so that it rotates in one direction when the shade is extending, and rotates the opposite direction when the shade is retracted.

Additionally, for instance, the particular structure of the split drive mechanism could be modified structurally but still operate in a similar manner. For instance, in one example, orientation of the magnets in FIG. 9, given the orientation of the drive member 148 and the driven member 150 therein, may be orthogonal; and correspondingly the orientation of the magnets in FIGS. 10*a* and 10*b*, given the orientation of the drive member 148 and the driven member 150 therein, may be parallel. If so modified, the layout of the spool, shaft, line and motor direction during extension and retraction would need to be modified such that in the downward, loaded motion of the shade the magnets were in an orthogonal orientation, and upon interruption or reaching terminal position when the engagement members would become unloaded and the magnets would align in parallel. This change in alignment of the magnets would thus cause the sensor to not sense any rotation, at which time the control system would send a stop signal to the motor 130.

Figure 14:
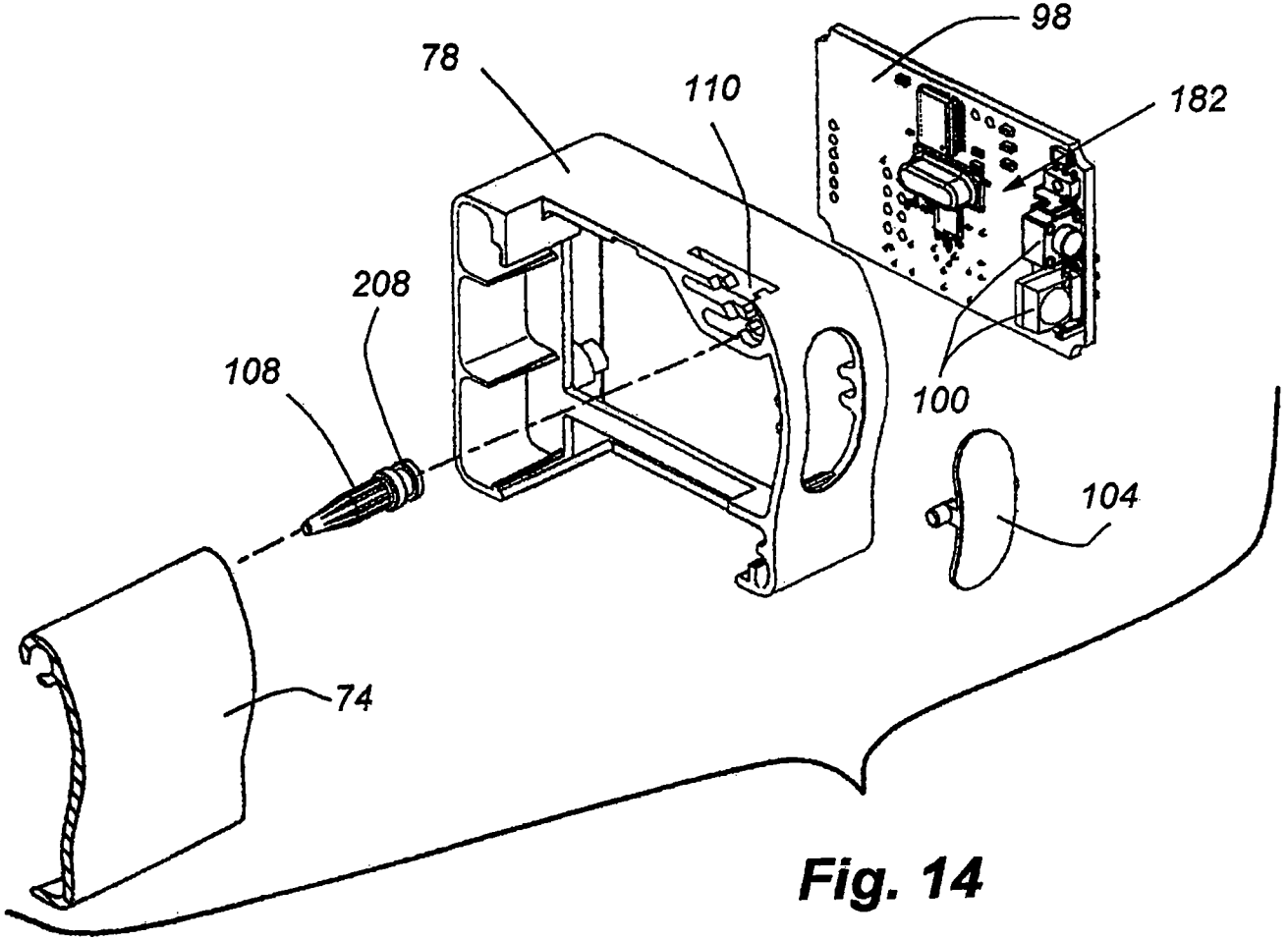
FIG. 14 is an exploded view of the components of FIGS. 12 and 13.

FIGS. 11, 12, 13, and 14 show various views of the head rail 56, and specifically the pivotal connection between one end of the front panel 74 and the end cap 78. The drop-in notch 110 is formed in the top surface of both one end cap 78 and the opposite end cap 78. The notch 110 receives an axle pin 108 that is positioned to extend from each of both of the ends of the top edge of the front panel 74. In one arrangement, the pin 108 includes a circumferential groove 208 that engages the walls of the drop-in notch 110, to help position the pin 108 securely in the notch 110. With the pin 108 on either end of the front panel 74 positioned in the corresponding notch 110, the front panel 74 may pivot between an open position and a closed position. In an open position as shown in FIG. 2, the battery holder 80 may be accessed and removed to allow replacement of the battery. The spools 66, cord 64, and rotating cord shaft 68 in the head rail 56 may be accessed if needed, and the motor assembly 72 may be accessed. When the front panel 74 is closed, the head rail 56 has a finished appearance. The button 104 shown in FIG. 11 may be actuated by a user to manually raise and lower the shade member 52. The button 210 engages the switch 100 on the circuit board 98, which switch 100 controls the motor assembly 72 to cause the actuation of the shade member 52. FIG. 14 shows an exploded view of the opposite end cap 90, pivot axle pin 108, front panel 74, circuit board 98 and button 104.

Figure 16:
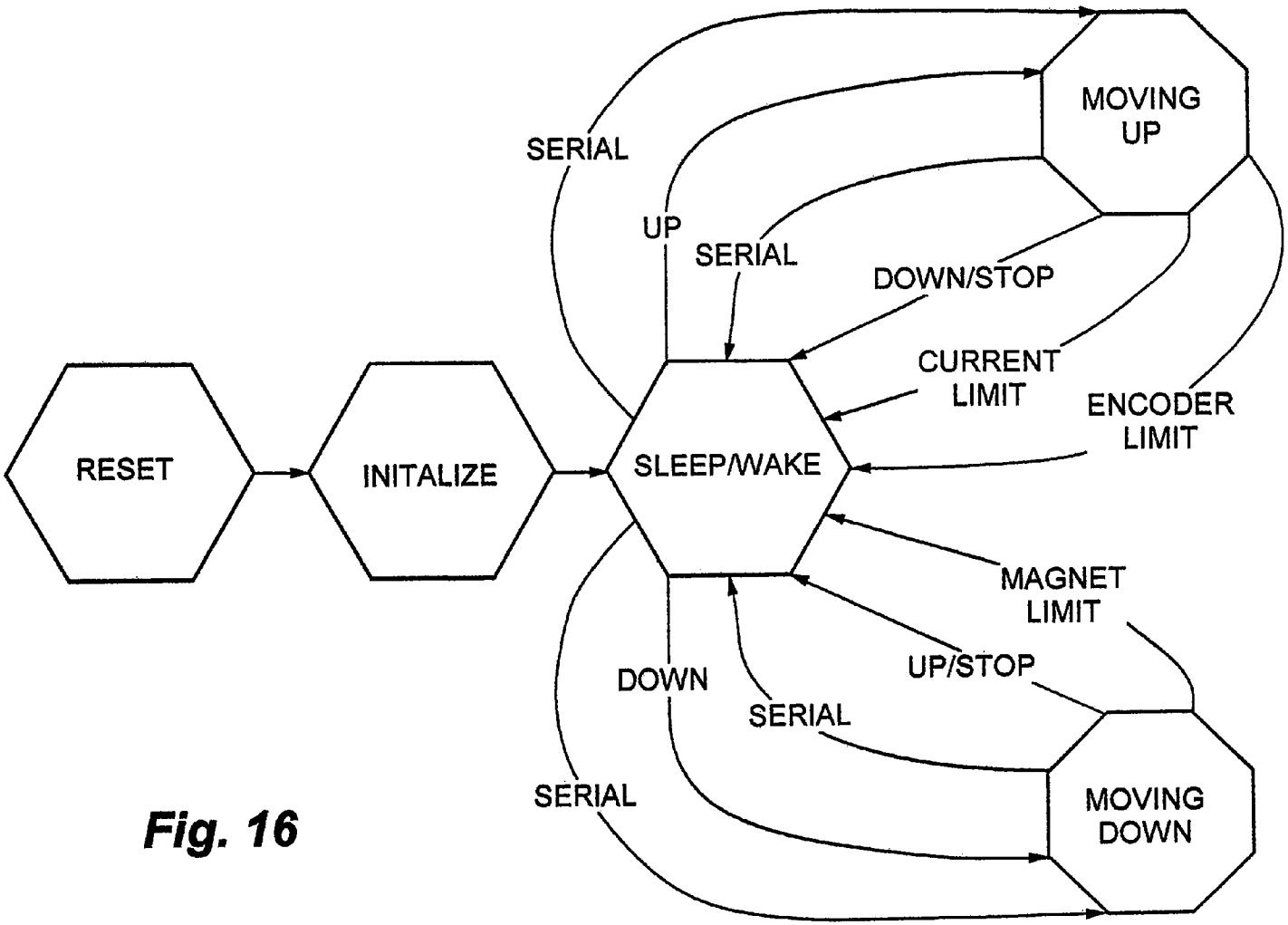
FIG. 16 is a instruction flow diagram for a control system able to be utilized with the present invention.

FIG. 16 shows one example of a instruction flow diagram for the control system 182.

It is contemplated that the invention disclosed and described herein may be used with other types of shade members than a collapsible shade member. For instance, the invention may be implemented with a roller-type shade where the shade member retracts by rolling up into a wind-up roller positioned in the head rail, as well as other types of shade structures where the shade member is moved between extracted and extended positions. The instant invention may also be used with shade structures where the shade retracts and extends vertically, or retracts and extends horizontally (such as vertical blinds). The shade structure may include slats or vanes made out of rigid or flexible materials and rolled or collapsed between an extended and retracted position. The electric motor described herein may be a two-way motor.

It is contemplated that the benefits described herein may be obtained by utilizing different structure and/or function. Other mechanisms that change the magnitude of a magnetic field, and thus the pattern of actuation of a sensor for collecting data and controlling the shade structure may also be employed. Different types of sensors may be employed, and different types of actuation means other than magnetic fields may be utilized to actuate the sensor.

While the methods disclosed herein have been described and shown with reference to particular steps performed in a particular order, it will be understood that these steps may be combined, subdivided, or re-ordered to form an equivalent method without departing from the teachings of the present invention. Accordingly, unless specifically indicated herein, the order and grouping of the steps are not generally intended to be a limitation of the present invention.

A variety of embodiments and variations of structures and methods are disclosed herein. Where appropriate, common reference numbers were used for common structural and method features. However, unique reference numbers were sometimes used for similar or the same structural or method elements for descriptive purposes. As such, the use of common or different reference numbers for similar or the same structural or method elements is not intended to imply a similarity or difference beyond that described herein.

The references herein to "up" or "top", "bottom" or "down", "lateral" or "side", and "horizontal" and "vertical", as well as any other relative position descriptor are given by way of example for the particular embodiment described and not as a requirement or limitation of the shade or the apparatus and method for assembling the shade. Reference herein to "is", "are", "should", "would", or other words implying a directive or positive requirement are intended to be inclusive of the permissive use, such as "may", "might", "could" unless specifically indicated otherwise.

The apparatus and associated method in accordance with the present invention has been described with reference to particular embodiments thereof. Therefore, the above description is by way of illustration and not by way of limitation. Accordingly, it is intended that all such alterations and variations and modifications of the embodiments are within the scope of the present invention as defined by the appended claims.

The invention claimed is:

1. A mechanism for indicating a position of a shade member moving in an extending direction comprising:

a shade member movable between a retracted and an extended position;

a motor drive;

an actuation member operably associated with said shade member and responsive to said motor drive to cause the retraction and extension of said shade member;

a drive mechanism operably positioned between said motor drive and said actuation member, said drive mechanism including a first magnet and a second magnet, said second magnet movable relative to said first magnet; and a control system operably associated with said motor drive, said control system monitoring a magnetic field generated by said first and second magnets and providing at least one control signal to said motor drive based on said magnetic field.

2. A mechanism as defined in claim 1, wherein said at least one control signal is instructions to turn off said motor drive.

3. A mechanism as defined in claim 2, wherein said control system provides said at least one control signal when said magnetic field is not detected.

4. A mechanism as defined in claim 1, wherein said drive mechanism is a split drive mechanism.

5. A mechanism as defined in claim 1, wherein said drive mechanism includes a drive member and a driven member, wherein said first magnet is associated with said drive member, and wherein said second magnet is associated with said driven member.

6. A mechanism as defined in claim 5, wherein said drive and driven members are rotatable relative to one another between an engaged state and a disengaged state.

7. A mechanism as defined in claim 6, wherein rotation of said drive and driven members relative to one another rotate said first and second magnets relative to one another, thereby varying said magnetic field.

8. A mechanism as defined in claim 6, wherein said first and second magnets bias said drive and driven members toward said disengaged state.

9. A method of detecting an obstruction or terminal position to an extension of a shade member comprising:

providing a drive mechanism including a set of magnets having a first orientation relative to one another during the extension of the shade member;

rotating one of said set of magnets relative to another of said set of magnets upon the shade member contacting the obstruction or reaching the terminal position; and monitoring a magnetic field generated by said set of magnets.

10. A method as defined in claim 9, wherein said drive mechanism includes a first engagement member and a second engagement member.

11. A method as defined in claim 10, wherein said one of said set of magnets is associated with said first engagement member and said another of said set of magnets is associated with said second engagement member.

12. A mechanism for indicating the interruption of a shade member moving in an extending direction comprising:

a shade member movable between a retracted and an extended position;

a motor drive;

an actuation member operably associated with said shade member and responsive to said motor drive to cause the retraction and extension of said shade member;

a control system operably associated with said motor drive and including a magnetic sensor;

a drive mechanism operably positioned between said motor drive and said actuation member, said drive mechanism including a first engagement member engaged with said motor drive and a second engagement member engaged with said actuation member, said first and second engagement members rotatable relative to one another between a first and a second orientations, wherein said first and second engagement members each include a magnet having a north and a south pole, wherein in said first orientation said north poles of each of said first and second engagement members are in proximity to one another and said south poles of each of said first and second engagement members are in proximity to one another;

said magnetic sensor sensing said rotation of said drive mechanism when said first and second members are in said first orientation, and not sensing said rotation of said drive mechanism when said first and second members are in said second orientation; and said control system, upon said magnetic sensor not sensing said rotation, sending at least one control signal to said motor drive to interrupt said motor drive.

13. A mechanism as defined in claim 12, wherein said first engagement member is a drive member and said second engagement member is a driven member.

14. A mechanism as defined in claim 12, wherein said first and second members automatically move from said first orientation to said second orientation when under no load.

15. A mechanism as defined in claim 12, wherein:

in said second orientation, said north pole of one engagement member is in proximity to said south pole of said other engagement member.

16. A mechanism as defined in claim 12, wherein:

said first and second engagement members rotate about a common axis.

17. A mechanism as defined in claim 12, wherein:

said transition from said first orientation to said second orientation results from an interruption of said downward motion of said shade member.

18. A mechanism as defined in claim 17, wherein:

said interruption is the maximum extension of said shade member.

19. A mechanism as defined in claim 17, wherein:

said interruption is an object interfering with the maximum extension of said shade member.

20. A method of detecting an obstruction or terminal position to an extension of a shade member comprising:

upon downward motion of said shade member, sensing a magnetic field generated by a plurality of magnets associated with a drive mechanism;

upon said downward motion being interrupted by the obstruction or by reaching the terminal position, no longer sensing said magnetic field; and upon no longer sensing said magnetic field, providing a control signal to a motor to arrest any further downward motion of said shade member.

* * * * *

UNITED STATES PATENT AND TRADEMARK OFFICE

CERTIFICATE OF CORRECTION

PATENT NO. : 8,540,005 B2
APPLICATION NO. : 13/123555
DATED : September 24, 2013
INVENTOR(S) : Baugh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 152 days.

Signed and Sealed this
Fifteenth Day of September, 2015

Michelle K. Lee

Michelle K. Lee
*Director of the United States Patent and Trademark Office*